US006502643B1

(12) United States Patent
Meyer et al.

(10) Patent No.: US 6,502,643 B1
(45) **Date of Patent: *Jan. 7, 2003**

(54) LOW PRESSURE, EARLY SUPPRESSION FAST RESPONSE SPRINKLERS

(75) Inventors: Stephen J. Meyer, Malvern; George S. Polan, Perkiomenville; James E. Golinveaux, North Wales, all of PA (US)

(73) Assignee: Central Sprinkler Company, Lansdale, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/183,990

(22) Filed: Nov. 2, 1998

Related U.S. Application Data

(63) Continuation of application No. 08/813,780, filed on Mar. 7, 1997, now Pat. No. 5,829,532.

(51) Int. Cl.[7] ..... A62C 37/08
(52) U.S. Cl. ..... 169/37; 169/38; 169/39; 169/40; 169/41
(58) Field of Search ..... 169/37, 38, 39, 169/40, 41

(56) References Cited

U.S. PATENT DOCUMENTS

| | | | |
|---|---|---|---|
| 2,357,227 A | 8/1944 | Rowley | |
| 2,389,334 A | 11/1945 | Tyden | |
| 2,502,754 A | 4/1950 | Rowley | |
| 3,525,402 A | 8/1970 | Hattori | 169/40 |

(List continued on next page.)

FOREIGN PATENT DOCUMENTS

| | | |
|---|---|---|
| DE | 25 08 355 A1 | 9/1976 |
| DE | 2816369 A1 | 10/1978 |
| EP | 215 331 A1 | 3/1987 |

(List continued on next page.)

OTHER PUBLICATIONS

*Standard for Installation of Sprinkler Systems NFPA 13* National Fire Protection Association, Quincy, MA, 1994 Edition, pp. 13–1 through 13–124.

(List continued on next page.)

*Primary Examiner*—Lesley D. Morris
*Assistant Examiner*—Davis Hwu
(74) *Attorney, Agent, or Firm*—Akin, Gump, Strauss, Hauer & Feld, L.L.P.

(57) ABSTRACT

A low pressure, early suppression fast response sprinkler includes a generally tubular body having an inlet end, an opposing discharge end and an internal passageway extending between the inlet and discharge ends with a K factor greater than 16 where the K factor equals the flow of water in gallons per minute through the internal passageway divided by the square root of the pressure of water fed into the tubular body in pounds per square inch gauge. A deflector is coupled with the tubular body and spaced from and generally aligned with the discharge end of the internal passageway so as to be impacted by a flow of water issuing in a column from the discharge end upon activation of the sprinkler. The deflector is configured and positioned to deflect the flow of water generally radially outwardly all around the sprinkler. A closure is releasably positioned at the discharge end of the tubular body so as to close the internal passageway by a heat responsive trigger mounted to releasably retain the closure at the discharge end of the tubular body. The trigger has a response time in rices (RTI) of less than 100 meter$^{1/2}$sec$^{1/2}$. A specific pendent sprinkler with a nominal K factor of 25, an RTI of less than 40 m$^{1/2}$sec$^{1/2}$ and delivering at least 100 gallons per minute at an operating pressure at or below 20 psig is described.

92 Claims, 3 Drawing Sheets

U.S. PATENT DOCUMENTS

| | | | | | |
|---|---|---|---|---|---|
| 3,682,251 | A | | 8/1972 | Livingston | 169/37 |
| 3,714,989 | A | | 2/1973 | Gloeckler | |
| 3,722,596 | A | | 3/1973 | Livingston | |
| 3,768,736 | A | | 10/1973 | Cox | 239/504 |
| 3,834,463 | A | | 9/1974 | Allard et al. | |
| 3,888,313 | A | | 6/1975 | Freeman | 169/16 |
| 3,904,126 | A | | 9/1975 | Allard | 239/502 |
| 3,998,273 | A | | 12/1976 | Juliano | |
| 4,091,873 | A | | 5/1978 | Werner | 169/37 |
| 4,099,675 | A | | 7/1978 | Wohler et al. | 239/498 |
| 4,109,727 | A | | 8/1978 | Job | |
| 4,113,021 | A | | 9/1978 | Werner | |
| 4,136,740 | A | | 1/1979 | Groos et al. | 169/39 |
| 4,167,974 | A | | 9/1979 | Job | |
| 4,273,195 | A | | 6/1981 | Fischer et al. | |
| 4,279,309 | A | | 7/1981 | Fischer et al. | 169/37 |
| 4,298,068 | A | | 11/1981 | Bray | |
| 4,343,364 | A | | 8/1982 | Glinecke | |
| 4,405,018 | A | | 9/1983 | Fischer | 169/37 |
| 4,553,603 | A | | 11/1985 | Dwyer | |
| 4,577,544 | A | | 3/1986 | Lee | |
| 4,580,729 | A | | 4/1986 | Pounder | 239/524 |
| 4,609,047 | A | | 9/1986 | Pieczykolan | |
| 4,619,327 | A | | 10/1986 | Pieczykolan | |
| 4,657,085 | A | | 4/1987 | Jacobsen | 169/38 |
| 4,739,835 | A | | 4/1988 | Polan et al. | |
| 4,757,865 | A | | 7/1988 | Simons | |
| 4,800,961 | A | | 1/1989 | Klein | 169/37 |
| 4,893,679 | A | * | 1/1990 | Martin et al. | 169/39 |
| 4,896,728 | A | | 1/1990 | Wolff et al. | |
| 4,901,799 | A | | 2/1990 | Pepi et al. | 169/39 |
| 4,930,578 | A | | 6/1990 | Barnett et al. | 169/39 |
| 4,938,294 | A | | 7/1990 | Mohler et al. | |
| 4,957,169 | A | | 9/1990 | Polan | |
| 4,976,320 | A | | 12/1990 | Polan | |
| 4,981,179 | A | | 1/1991 | Klein | |
| 5,020,601 | A | | 6/1991 | Retzloff et al. | |
| 5,036,923 | A | | 8/1991 | Shea | 169/37 |
| 5,083,616 | A | | 1/1992 | Polan | |
| 5,094,298 | A | | 3/1992 | Polan | 169/37 |
| 5,109,929 | A | | 5/1992 | Spears | |
| 5,366,022 | A | | 11/1994 | Meyer et al. | 169/37 |
| 5,511,621 | A | | 4/1996 | Yao | |
| 5,579,846 | A | | 12/1996 | Meyer et al. | 169/37 |
| 5,584,344 | A | | 12/1996 | Meyer et al. | 169/37 |
| 5,609,211 | A | | 3/1997 | Meyer et al. | 169/37 |
| 5,622,225 | A | * | 4/1997 | Sundholm | 169/38 |
| 5,647,438 | A | | 7/1997 | Chatrathi et al. | |
| 5,664,630 | A | | 9/1997 | Meyer et al. | 169/37 |
| 5,669,449 | A | | 9/1997 | Polan et al. | |
| 5,722,599 | A | | 3/1998 | Fries | |
| 5,810,090 | A | | 9/1998 | Sundholm | |
| 5,810,263 | A | | 9/1998 | Tramm | |
| 5,829,532 | A | * | 11/1998 | Meyer et al. | 169/37 |
| 5,829,684 | A | | 11/1998 | Fishcer | |
| 5,839,667 | A | | 11/1998 | Fishcer | |
| 5,862,994 | A | | 1/1999 | Pounder et al. | |
| 5,865,256 | A | | 2/1999 | Pounder | |
| 5,890,657 | A | | 4/1999 | Ponte | |
| 5,915,479 | A | | 6/1999 | Ponte | |
| 5,967,238 | A | | 10/1999 | Pepi et al. | |
| 6,059,044 | A | * | 5/2000 | Fischer | 169/37 |
| 6,082,463 | A | | 7/2000 | Ponte | |
| 6,336,509 | B1 | | 1/2002 | Polan et al. | |

FOREIGN PATENT DOCUMENTS

| | | | |
|---|---|---|---|
| EP | 331 423 | A2 | 9/1989 |
| EP | 339 788 | A3 | 11/1989 |
| EP | 339 788 | A2 | 11/1989 |
| EP | 347876 | A2 | 12/1989 |
| EP | 1010 442 | A2 | 6/2000 |
| GB | 1027930 | A | 4/1966 |
| GB | 2 120 934 | A | 12/1983 |
| GB | 2 195 241 | A1 | 4/1988 |
| IT | 566782 | | 3/1959 |
| JP | 10108918 | | 4/1998 |
| JP | 10118220 | | 5/1998 |
| JP | 11057058 | | 3/1999 |
| JP | 11299921 | | 11/1999 |
| SU | 1768188 | A1 | 10/1992 |
| WO | WO 93/06891 | A1 | 4/1993 |
| WO | WO 94/26354 | A1 | 11/1994 |

OTHER PUBLICATIONS

Meeting Minutes, New Technology Task Group and Working Group Meetings at Underwriters Laboratories, Inc., Northbrook, IL, Jun. 23–24, 1994, 8 pp.

Meeting Minutes, NFPA 13 New Technology Task Group Special Task Force, Jun. 24,1994 Meeting, Underwriters Laboratories, Inc., 4 pp.

Meeting Minutes, NFPA 13 New Technology Task Group Special Task Force, Aug. 2 and 3, 1994 at National Fire Protection Association, 6 pp.

Meeting Minutes (draft), NFPA 13 New Technology Task Group Special Task Force, Sep. 13 and 14, 1994 at NFPA, 2 pp.

Meeting Minutes, National Fire Sprinkler Association, Inc. Engineering and Standards Committee, Sep. 22–23, 1994 at Burlington, VT. 15 pp.

Meeting Minutes, NFPA 13 New Technology Task Group, Feb. 23, 1995 at Chantilly, VA, 3 pp.

*Sprinkler Tech Notes*, National Fire Sprinkler Association, Inc., Patterson, NY, vol. XVIII No. 4, Jul./ Aug., 1995, 4 pp.

*1996 Annual Meeting Report on Proposals*, National Fire Protection Association, Quincy, MA, Aug., 1995, pp. 693–804.

Meeting Minutes, National Fire Sprinkler Association, Engineering and Standards Committees, Sep. 28–29, 1995 at , Reno, NV, 14 pp.

*1996 Annual Meeting Report on Comments*, National Fire Protection Association, Quincy, MA, 1996, pp. 172–204.

*NFPA 13 Installation of Sprinkler Systems*, National Fire Protection Association, Qunicy, MA, Jul., 1996, pp. 13–1 through 13–148 plus r unnumbered sheets.

M. Puchovsky, *Entering the Next 100 Years of Standardized Sprinkler System Technology, Sprinkler Age*, American Fire Sprinkler Association, Inc., Dallas, TX, Vol. 15, No. 3, Mar., 1998, pp. 5, 10, 12, 14, 15, 18 and 19.

Fleming, P., "Applications/Limitations of QRS Technology", *Fire Safety Journal* 14, Elsevier Scientific Ltd., Kidlington, Oxford, UK, (1988) pp. 75–88.

Krasner, L.M., et al., Technical Report No. AFWL–TR–71–149, "Fire Protection Study USAF Mobility Program Structures and Large Air Force Warehouses Phase 1", Factory Mutual Research Corp., Norwood, MA pp: cover, i–vi, 1–51.

Krasner, L.M., et al., Technical Report No. AFWL–TR–72–246, "Fire Protection Study USAF Mobility Program Structures and Large Air Force Warehouses Phase 2", Factory Mutual Research Corp., Norwood, MA pp: Cover, iii–viii, 1–59.

DD Form 1473 for Technical Report AFWL–TR–71–149, 2 pp.

Yao, Cheng, Collection of slides entitled "Evolution of Automatic Sprinkler Fire Protection Systems", Factory Mutual Research Corporation, Norwood, MA (May 16, 1996), pp. 16.
*FMRC Update*, Factory Mutual Research Corp., Norwood, MA, vol. 12, No. 1 (1998), 4 pp.
*FMRC Update*, Factory Mutual Research Corp., Norwood, MA, vol. 12, No. 2 (1998), 4 pp.
"Which Sprinkler Will Best Protect Your Warehouse?", *Record*, Factory Mutual, Norwood, MA (Mar.–Apr. 1991), pp. 3–10.
"ESFR: Expanding Applications and Benefits", *Record*, Factory Mutual, Norwood, MA (Jan.–Feb. 1992), 5 pp.
"New Protection Criteria and a Better Plastic Pallet", *Record*, Factory Mutual, Norwood, MA (Nov.–Dec. 1992), 4 pp.
"ESFR: Around the World", *Record*, Factory Mutual, Norwood, MA, (Second Quarter 1997), pp. 6–13.
Kung, Hisiang–Cheng, et al., "Early Suppression, Fast Response (ESFR) Sprinkler Protection For 12 m High Warehouses", International Association for Fire Safety, Fire Safety Science Proceedings of the Fifth International Symposium, (Mar. 19, 1997), 12 pp.
Nam, Soonil, "Development of a Computational Simulating the Interaction Between a Fire Plume and a Sprinkler Spray", reprint from *Fire Safety Journal* 26, Elsevier Science Ltd. (1996), pp. 1–33.
Mangan, Joseph F., "ESFR Sprinklers: Advances in Fire Protection", reprint from *Best's Underwriting Newsletter*, A.M. Best Co., Oldwick, NJ, V19, No. 2, (Feb. 1990), 4 pp.
"ESFR: Expanding Applications and Benefits", Factory Mutual Research Corp., Norwood, MA (2/92), 6 pp.
Wilcox, W.E., "Early Suppression, Fast Response Sprinklers Reduce Losses", *Consulting–Specifying Engineer*, (Apr. 1990), 4 pp.
Casaccio, E. K., "Sprinkler Technology Research", *Sprinkler Age*, (Feb. 1990), cover and 3 pp.
*Record*, Factory Mutual, Norwood, MA, V. 61, No. 1, (Spring 1984), 23 pp.
*Record*, Factory Mutual, Norwood, MA, (Summer 1984), p. 23.
*Record*, Factory Mutual ,Norwood, MA, (Spring 1985) p. 17.
*Record*, Factory Mutual, Norwood, MA, (Nov.–Dec. 1988) p. 22.
*Record*, Factory Mutual, Norwood, MA, (Jan.–Feb. 1989) pp. 7–9.
*Record*, Factory Mutual, Norwood, MA (May–Jun. 1989) pp. 9–11.
*FMRC Update*, Factory Mutual Research Corp., Norwood, MA, V. 1, No. 1 (1987), 6 pp.
*FMRC Update*, Factory Mutual Research Corp., Norwood, MA, V. 1, No. 2 (1987), pp. 1–4.
*FMRC Update*, Factory Mutual Research Corp., Norwood, MA, V. 2, No. 1 (1988), pp. 1–4.
*FMRC Update*, Factory Mutual Research Corp., Norwood, MA, V. 2, No. 2 (1988), pp. 1–4.
*FMRC Update*, Factory Mutual Research Corp., Norwood, MA, V. 3, No. 1 (1989), pp. 1–4.
*FMRC Update*, Factory Mutual Research Corp., Norwood, MA, V. 3, No. 2 (1989), pp. 1–4.
*FMRC Update*, Factory Mutual Research Corp., Norwood, MA, V. 4, No. 1 (1990), pp. 1–4.
*ESFR Update*, Factory Mutual Engineering Corp., Norwood, MA, vol. 1, No. 1 (1984), pp. 1–4.
*ESFR Update*, Factory Mutual Engineering Corp., Norwood, MA, vol. 1, No. 2 (1984), pp. 1–4.
*ESFR Update*, Factory Mutual Engineering Corp., Norwood, MA, vol. 1, No. 3 (1984), pp. 1–4.
*ESFR Update*, Factory Mutual Engineering Corp., Norwood, MA, vol. 2, No. 2 (1985), pp. 1–4.
*ESFR Update*, Factory Mutual Engineering Corp., Norwood, MA, vol. 2, No. 3 (1985), pp. 1–4.
Yao, C., Performance and Criteria—Automatic Sprinkler Systems; CIB Symposium on Systems Approach to Fire Safety in Buildings, Tsukuba, Japan, (Aug. 1979), 47 pp.
Thomas, S. "A Revolution in Sprinkler Technology", *Building Standards*, (May–Jun. 1984), 2 pp.
Yao, C., "The Development of the ESFR Sprinkler System", *Fire Safety Journal*, 14 (1988), pp. 65–73.
*Approved Product News*, Factory Mutual Engineering Corp., Norwood, MA, V. 4, No. 2, (Dec. 1988), 10 pp.
Yao, C., "Early Suppression Fast Response Sprinkler Systems", *Chemical Engineering Progress*, (Sep. 1988), pp. 38–43.
"Warehousing New Sprinklers Put Out Fires, Save on Costs", *Modern Materials Handling*, (Dec. 1988), 1 pp.
Anderson, K., "Mass. Venture a Leader in Loss Prevention", *The Journal of Commerce*, (Apr. 10, 1989), 2 pp.
"Early suppression—fast response: The future of fire control", *Engineer's Digest*, (Aug. 1989), 5 pp.
Miller, C. "Early Suppression—Fast Response Sprinklers: A New Level of Industrial Fire Protection", reprint from *National Engineer*, (Sep. 1989), 2 pp.
"ESFR: Superior Warehouse Fire Protection", *Transportation & Distribution*, (Sep. 1989), 2 pp.
*ESFR Technology Facing Today's Challenges*, Factory Mutual Engineering Corp., Norwood, MA., (May 1988), 8 pp.
*Approval Standard for Early Suppression—Fast Response (ESFR) Automatic Sprinklers/Class No. 2008*, Factory Mutual Research Corp., Norwood, MA, (Aug. 1996) 53 pp. (including ERRATA addition to p 9).
*Prevention*, Factory Mutual Engineering Corp., Norwood, MA, (Aug. 1996), 36 pp.
Yao, C., "Overview of Sprinkler Technology Research", International Association for Fire Safety, Fire Safety Science Proceedings of the Fifty International Symposium, (Mar. 19, 1997), pp. 93–110.
"*Preliminary Guidelines* ESFR Sprinklers", Factory Mutual Research Corp., Norwood, MA, (Jan. 1984), 12 pp.
Viking Technical Data "Sprinkler Installation Care And Maintenance Requirements", The Viking Corp., Hastings, MI, (Jan. 1987), 3 pp.
"Equipment Application Data High Challenge Sprinklers Application Report: Digital Equipment Corporation", The Viking Corp., Hastings, MI (May 1986), 4 pp.
"How Digital Cuts the Risk of Storage Rack Fires", *Modern Materials Handling*, (Feb. 1986), pp. 74–76.
Scott, J. et al., "The Goal Is In Sight",. *Aerosol Age*, (Jun. 1987), cover and pp. 21–23.
Groos, R.T., "The Large Drop Sprinkler", *Sprinkling of News Quarterly*, (Dec. 1982), pp. 9–11.
Groos, R.T., Letter to Viking Customers, The Viking Corp., Hastings, MI (Oct. 1984), 2 pp.

Groos, R.T., "Sprinkler Protection in Rack Storage A Progress Report", The 5th Annual Convention of American Fire Sprinkler Association, Ahaheim, CA (Sep. 1986), 10 pp.

Groos, R.T., "Large–Drop Sprinklers: Management of High–Challenge Fires in Buildings", *Reeves Journal*, (Jan. 1986), cover and pp. 9, 10 and 12.

Groos, R.T., "Management of Fire in Buildings", *Plumbing Engineer*, (Mar.,–Apr. 1985), cover and pp. 33–36.

Fleming, R. "Applications/Limitations of QRS Technology", *Sprinkler Quarterly*, (Spring 1987), pp. 15–27.

Groos, R.T., "Large–Drop Sprinklers: Management of High–Challenge Fires In Buildings", ASPE 1984 Biennial Convention Technical Sessions , American Society of Plumbing Engineers, 11 pp.

Groos, R.T., "The Large Drop Sprinkler", *Sprinkler Quarterly*, (Fall 1983), pp. 38–39.

Sprinkler Technotes, National Fire Sprinkler Association, Patterson, NY, V. VI, No. 4, (Jul.–Aug. 1983), 3 pp.

"Sprinklers in Storage Areas: A Comparison of Standards", *Fire*, (Jul. 1983), pp. 41–42.

Loss Prevention Data 2–7, "Installation Rules for Sprinkler Systems Using Large–Drop Sprinklers", Factory Mutual Engineering Corp., Norwood, MA (Apr. 1983), 10 pp.

Loss Prevention Data 7–29S, "Storage of Aerosol Products", Factory Mutual Engineering Corp., Norwood, MA (May. 1983), 14 pp.

Sprinkler Technotes, National Fire Sprinkler Association, (Nov.–Dec. 1993) p. 2.

"Technically Speaking Sprinkler Technology: Research on Sensitivity", *Record*, Factory Mutual, Norwood, MA, (Fall 1983), pp. 19–21.

Sherwood, S. "K Mart Learns Lessons From Warehouse Disaster", *business insurance*, (Oct. 31, 1983), 1 pp.

"A Large Loss for K mart: A Lesson For Others", Factory Mutual, Norwood, MA, (1983), 8 pp.

Entwisle, N., et al., "What Happened At K–Mart's Giant Warehouse?", *Distribution*, (1983), 4 pp.

Best, R., "$100 Million Fire In K Mart Distribution Center", *Fire Journal*, (Mar. 1983), pp. 36–43.

Yao, C., et al., "Effect of Drop Size on Sprinkler Performance", National Fire Protection Association 74th Annual Meeting, Toronto, CA, (May 1970), 29 pp.

Heskestad, G., et al., Technical Report FMRC J.I. 3A1E2.RR "Plunge Test for Determination of Sprinkler Sensitivity", Factory Mutual Research Corp., Norwood, MA, (Dec. 1980), 67 pp.

Chicarello, P.J., et al., Technical Report FMRC J.I. 0F0R2.RR "Fire Test in Roll Paper Storage Phase II", Factory Mutual Research Corp., Norwood, MA, (Feb. 1981), 256 pp.

Goodfellow, D.G., et al., Technical Report FMRC J.I. 0H4R7.RR "Large–Scale Fire Tests to Study Sprinkler Sensitivity", Factory Mutual Research Corp., Norwood, MA (Mar. 1983), 191 pp.

Fleming, R.P., "Quick Response Sprinklers A Technical Analysis", National Fire Protection Research Foundation, Quincy, MA, (Apr. 1985), 115 pp.

Goodfellow, D.G., Technical Report FMRC J.I. 0M0J5.RR "A Statistical Model for Analysis of Sprinkler Water–Spray Distributions", Factory Mutual Research Corp., Norwood, MA, (Aug. 1985), 40 pp.

Chicarello, P.J., et al., Technical Report FMRC J.I. OM2R5.RR/OMOJ7.RR "Large Scale Fire Test Evaluation of Early Suppression Fast Response (ESFR) Automatic Sprinklers", Factory Mutual Research Corp., Norwood, MA, (Sep. 1985), 171 pp.

ESFR Update, Factory Mutual Engineering Corp., Norwood, MA, vol. 2, No. 1 (1985), pp. 1–4.

Yao, C., "The ESFR Sprinkler System: A New Approach to High–Challenge Storate Protection", *Fire Journal*, (Mar. 1985), pp. 30–33, 70–72.

Beck, L., "How Digital Cuts the Risk of Storage Rack Fires", *Modern Materials Handling*, (Feb. 1986), pp. 74–76.

*Sprinkler Quarterly*, (Winter 1983–84), pp. 16–23.

Yao, C., "Early Suppression of High–Challenge Fires", *Specifying Engineer*, (1985), pp. 7–11.

Groos, R.T., "Sprinkler Developments Help Control Today's Building Fires", *Specifying Engineer*, (May 1985), pp. 78–80.

*Report*, Kemper Group, Long Grove, IL, V. 13, No. 1 (Apr. 1984), 24 pp.

Thorne, P.F., et al., "The Thermal Performance of Sprinkler Heads", Fire Research Station, Building Research Establishment, UK (1987), 26 pp.

Carey, W., "Early Suppression Fast Response Sprinklers—A New Technology", *Building Standards*, (Jul.–Aug. 1986), pp. 6–10.

*Early Suppression—Fast Response Sprinklers* (*ESFR*), "Automatic" Sprinkler Corp. of America, Cleveland, OH (Dec. 1986), pp. 1–4.

*Early Suppression–Fast Response Sprinklers* (*ESFR*) ESFR Update—2, "Automatic" Sprinkler Corp. of America, Cleveland, OH (Feb. 1987), pp. 1–3.

*Report*, Kemper Group, Long Grove, IL, V. 16, No. 1, (Spring 1984), pp 1–15, 17–23.

*Report*, Kemper Group, Long Grove, IL, V. 16, No. 3, (Dec. 1987), pp. 1–16.

Viking Technical Data "High Challenge® Model 'A' Upright", The Viking Corp., Hastings, MI, (Feb. 1983), 1 pg.

Viking Technical Data "High Challenge® Quick Response Large Drop Sprkinler", The Viking Corp., Hastings, MI, (1971), 2 pp.

"Equipment Application Data High Challenge® Sprinklers", The Viking Corp., Hastings, MI (1984), 4 pp.

File Ex643 "Report on Automatic Sprinklers", Underwriters Laboratories, Inc., (May 1981), 18 pp.

*The Q.R.S. "Link"*, National Fire Protection Research Foundation,Quincy, MA, (Jan.–Feb. 1986), 4 pp.

"Heat–Sensing Sprinkler Snuffs Fires Faster", *Design News*, (Dec. 18, 1989), pp. 88–89.

Campbell, L.E., Letter to Factory Mutual Research Corporation, The Reliable Automatic Sprinkler Co., Inc., Mount Vernon, NY, (Dec. 3, 1974).

Miller, C.E., Letter to the Reliable Automatic Sprinkler Co., Inc., A Factory Mutual Systems, Norwood, MA, (Dec. 17, 1974) 1 pp.

"Ultra™ K–25 ESFR Low Pressure Early Suppression Fast Response", Central Sprinkler, (Oct. 1997), 4 pp.

"Directional Spray Nozzles, Open Type D3 Large Capacity Protectospray®–1" NPT, Grinnell Corp., Exeter, NH, (Nov. 1992), 4 pp.

Sheet entitled "Grinnell Protectospray Nozzle Type D3 (Large Capacity)", Grinnell Corporation, (Apr. 1964), 1 pp.

Drawing entitled "Grinnell Large Capacity Protectospray Nozzle Type D–3 Frame", "B–1800", Grinnell Corporation, (Jun. 1981), 1 pp.
Drawing entitled "Grinnell Large Capacity Protectospray Nozzle Type D–3 Assembly", B–1801, Grinnell Corporation, (*Jun. 1981), 1 pp.
Drawing Entitled "Grinnell Protectospray Nozzle Type D–3, D–4 Splitter" and "A 7023", Grinnell Corporation, (Dec. 1966), 1 pp.
Drawing Entitled "Grinnell Protectorspray Nozzle Type D–3, Deflector", Grinnell and "A–3780", Grinnell Corporation, (Jan. 1974), 1 pp.
Collection of figures, Figure 1—Figure 7 entitled "Types D–3 and D–4a Protectospray Nozzles", Figure 8—Figure 9 entitled "Type D3 Large Capacity Protectospray Nozzles" and Figure 10—Figure 13 entitled "Type EA–1 Protectospray Nozzles", Grinnell Corporation, (Sep. 1985), 13 pp.
Underwriters Laboratories, Inc., UL 1767, "Standard For Safety, Early–Suppresion Fast–Response Sprinklers", First Edition, Feb., 1990.
Factory Mutual Engineering Corp., "Loss Prevention Data, 2–2", "Early Suppression Fast Response Sprinklers", Apr., 1987.
Factory Mutual Research,"Approval Standard, Early Suppression Fast Response Automatic Sprinklers", Jun., 1986.
"Automatic" Sprinkler Corporation of America product sheets entitled "Automatic ESFR Glass Bulb Sprinkler", Feb., 1998, (pp. J 5.3, J 5.4).
ASCOA Fire Systems data sheets entitled, "Automatic ESFR Glass Bulb Sprinkler", Mar., 1992, (pp. 1.1, 1.2).
Grinnell Corporation data sheets entitled "Early Suppression Fast Response Sprinklers/ Model ESFR–1 Pendent, 14.3 K–Factor", Apr., 1988.
Reliable Automatic Sprinkler product announcement, "ESFR, Model H Early Suppression Fast Response Sprinkler", Oct., 1992, (3 pp. total).
Central Sprinkler Company catalog sheets entitled, "Central ESFR–1 3–93/ESFR Early Suppression Fast Response", 4 pp. Mar., 1993.
Drawing entitled "International Jumbo Sprinkler Head—Deflector", DWG. No. 1–117, Automatic Sprinkler Co. Of America, Mar., 1926 (1 pg.).
Sheet entitled "Grinnell Jumbo Sprinkler Issue A", Grinnell Corp., Feb., 1969, (1 pg.).
Drawing entitled "Solder Type—Issue "A" 1 1/4" Grinnell Jumbo Sprinkler York, Body, Strut, Diaphragm And Disc, General Fire Extinguisher Company, Apr., 1917 (1 pg.).
Drawing entitled "1" Grinnell Jumbo Sprinkler Detail Solder Type Issue 'A', General Fire Extinguisher Co., Apr., 1917, (1 pg.).
N.J. Thompson, *Fire Behavior And Sprinklers*, Chapter 6 "Automatic Sprinkler Protection", National Fire Protection Association, 1964, Cover, Foreward, Table of Contents and pp. 72–91.
Newsletter for Fire Protection Engineers And Industry, No. 11, Jul., 1965, Orinda, California (8 pp.).

D.G. Goodfellow, et al., *Technical Report* entitled "*Optimization Of Sprinkler Protection For United States Postal Service* III. Protection Of Plastic Letter Trays", Factory Mutual Research Corporation, Oct., 1971 (39 pp.).

D.G. Goodfellow, Technical Report entitled "Optimization Of Sprinkler Protection For United States Postal Facilities/ IV Protection Of Plastic Letter Trays With 0.64–In. Retrofit Sprinklers", Factory Mutual Research Corporation, Jul., 1974 (30 pp. with cover and introductory pages).

E.W.J. Troup, *Technical Report* entitled "New Developments In Ceiling–Level Protection For The High–Challenge Fire", Factory Mutual Research Corporation, Jan., 1974.

P.J. Chicarello et al., *Technical Report* entitled Large–Scale Fire Test Evaluation Of Early Suppression Fast Response (ESFR) Automatic Sprinklers, Factory Mutual Research Corporation, (cover—p. 18 and pp. 122–128), May, 1986.

C. Yao, "The Development of the ESFR Sprinkler System", *Fire Safety Journal*, Elsevier Scientific Ltd. Kidlington, Oxford, U.K., vol. 14, No. 1, pp. 65–73, 1988.

C. Yao, "Overview Of FMRC'S Sprinkler Technology Research", Factory Mutual Research Corp., May, 1992.

*Approved Product News*, Factory Mutual Engineering Corp., vol. 4, No. 2, Dec., 1988, pp. 1–5, 8–12 and 16.

*Fire Protection Handbook*, Seventeenth Edition, National Fire Protection Association, 1991, Title page, inner page, Table of Contents p. IX and pp. 5–127 through 5–163 and 5–174 through 5–197.

K. Bell, "Presentation To American Fire Sprinkler Association—Large K–Factor Sprinklers", Nov., 1992, (59 pp. total: 19 pp. text and 40 pp. slide photocopies).

Color photocopies of six color photographs of sprinkler cast with "I.S. Co." on deflector and "PAT.03" on the body and "1903" stamped on the release link (labeled Jun., 1995) (2pp.).

Color photocopies of six color photographs of sprinkler cast with "Globe" and "280" on body, "G A S Co." on deflector and stamped "1926" on release link (labeled Jun., 1995) (2 pp.).

Color photocopies of five color photographs of Grinnell Corporation "Jumbo A" automatic sprinkler—1 1/4 orifice, (labeled Jun., 1995) (2 pp.).

Color photocopies of five color photographs of Grinnell Corporation "Jumbo A" automatic sprinkler—1 orifice, (labeled Jun., 1995) (2 pp.) (body painted red).

* cited by examiner

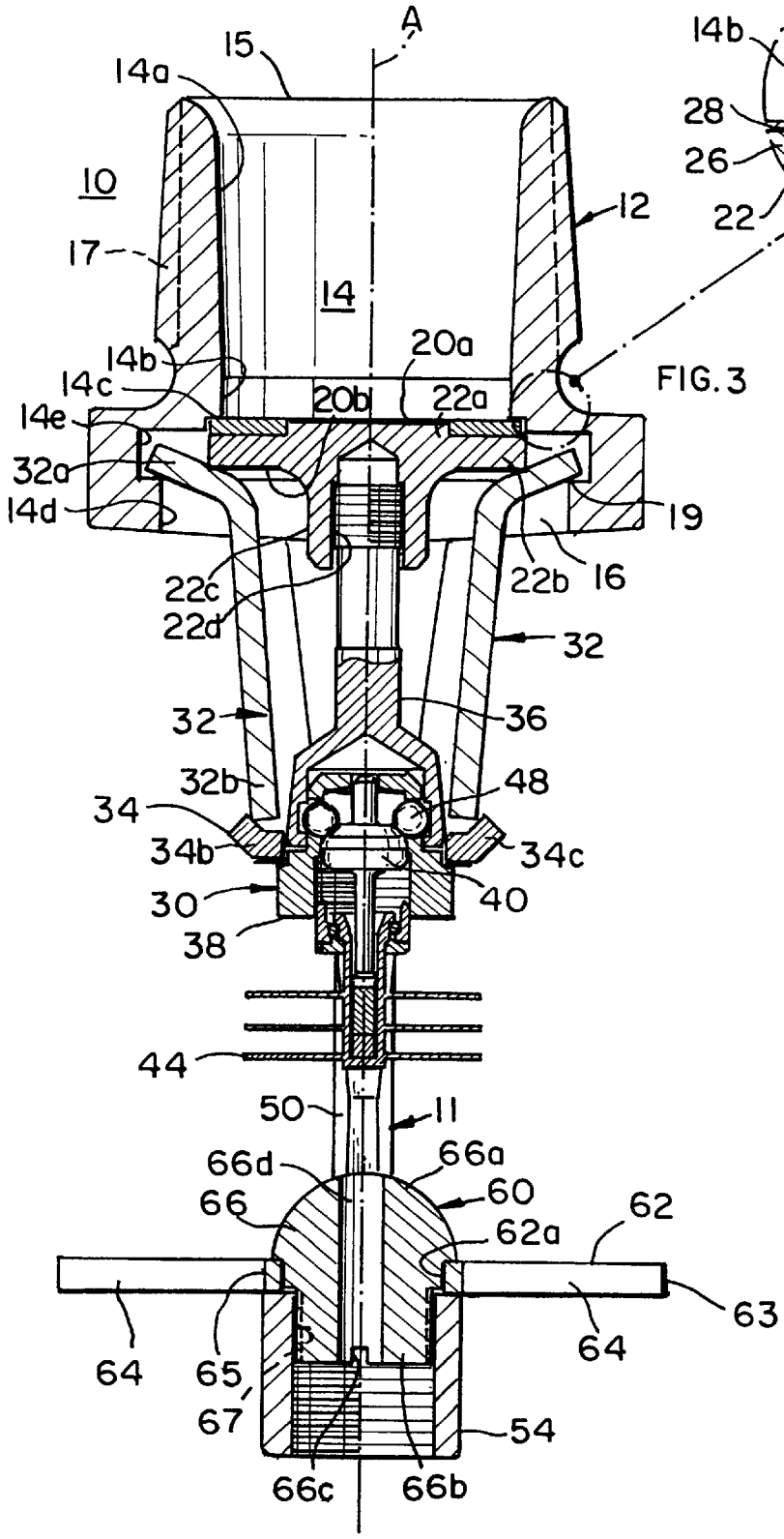
FIG. 2
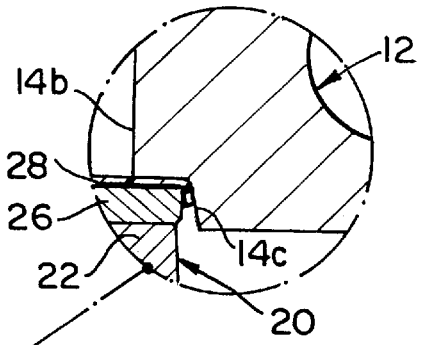
FIG. 3
FIG. 3

LOW PRESSURE, EARLY SUPPRESSION FAST RESPONSE SPRINKLERS

This is a continuation of Ser. No. 08/813,780 filed Mar. 7, 1997 now U.S. Pat. No. 5,829,532.

BACKGROUND OF THE INVENTION

Early suppression fast response ("ESFR") sprinklers are a well known and well defined class of ceiling fire sprinklers. ESFR sprinklers were developed in the 1980's by Factory Mutual Research Corporation ("FM") with the assistance of certain sprinkle manufacturers in an effort to provide improved fire protection against certain high-challenge fire hazards. According to FM, ESFR sprinklers combine fast response with greater supplied and actually delivered water densities for greater fire suppression capability. Previous sprinklers (standard sprinklers) provided protection by merely keeping such fires under control. Ultimately the initial fuel source would deplete itself or other fire fighting equipment would have to be brought to the scene to extinguish the fire.

The performance requirements of ESFR sprinklers are set forth in Underwriters Laboratories, Inc. ("UL") STANDARD FOR EARLY-SUPPRESSION FAST-RESPONSE SPRINKLERS UL 1767. This standard was first published in 1990. Factory Mutual Research Corporation ("Factory Mutual" or "FM") also has an Approval Standard For Early Suppression—Fast Response (ESFR) Automatic Sprinklers, Class Number 2008. The current ESFR standards and all earlier ESFR standards of either organization are incorporated by reference herein in their entirety.

Requirements for the installation and use of ESFR sprinklers are included in various standards of the National Fire Protection Association including the Standard for the Installation of Sprinkler Systems, NFPA 13; the Standard for General Storage, NFPA 231; and the Standard for Rack Storage of Materials, NFPA 231c. The current and editions of these standards to the extent that they pertain to ESFR sprinklers are incorporated by reference herein. Installation and use requirements for ESFR sprinklers are also given Loss Prevention Data sheets 2-2, "EARLY SUPPRESSION FAST RESPONSE SPRINKLERS", *Factory Mutual System,* Factory Mutual Engineering Corp., 1987, which is also incorporated by reference herein. Loss Prevention Data sheets 2-8 N, "Installation of Sprinkler Systems", *Factory Mutual System.* Factory Mutual Engineering Corp., 1989, presents other installation and use requirements for ESFR and other sprinklers generally which are not presented in Loss Prevention Data sheets 2-2 and is also incorporated herein.

The standards specify the construction, performance, installation and operation of ESFR sprinklers with significant particularity. For example, the discharge coefficient (or "K" factor) of an ESFR sprinkler is nominally 14 and must be within the range of 13.5–14.5, where the discharge coefficient is calculated by dividing the flow of water in gallons per minute through the sprinkler by the square root of the pressure of water supplied to the sprinkler in pounds per square inch gauge. Ordinary or standard sprinklers are considered to have response time indices ("RTI") of 100 meter$^{1/2}$second$^{1/2}$ ("m$^{1/2}$sec$^{1/2}$") or more although the response time indices actually reported for these sprinkler have all exceeded 100 m$^{1/2}$sec$^{1/2}$. One special class of faster operating sprinklers exists with response time indices between 50 and 80 m$^{1/2}$sec$^{1/2}$. Existing ESFR sprinklers must exhibit response time indices of less than 40 m$^{1/2}$sec$^{1/2}$.

The installation and use standards further require, among other things, that a minimum operating pressure of 50 psi be provided to ESFR sprinklers.

ESFR sprinklers were originally designed to suppress fires in warehouse with thirty-foot ceilings where flammable stock such as certain plastics is piled up to twenty-five feet high in racks. In many instances, available water supplies are not capable of providing a minimum operating pressure of 50 psi to thirty-foot high sprinklers. In such cases, a supplemental pump is needed to boost water pressure before ESFR sprinklers can be used. The cost of providing an auxiliary pump can be significant. For example, in protecting a 40,000 square foot building with ESFR sprinklers, it is estimated that the cost of providing an auxiliary pump can represent about twenty-five (25) per cent of the entire cost of the installed sprinkler system. In certain installations, a second, back-up pump may be needed. If comparable protection might be provided at pressures below the current 50 psig minimum required pressured for ESFR sprinklers, the need for a pump might be avoided. In instances where a pump would be required in any event, lower pressure requirements may permit the use of a lower capacity, less expensive pump or the use of the same pump with smaller diameter, higher friction but less expensive supply lines. Each of these three possible options could provide significant savings in installation costs of ESFR sprinklers.

BRIEF SUMMARY OF THE INVENTION

In one aspect the invention is a low pressure, early suppression fast response sprinkler comprising a generally tubular body having an inlet end, an opposing discharge end and an internal passageway extending between the inlet and discharge ends with a K factor greater than 16 where the K factor equals the flow of water in gallons per minute through the internal passageway divided by the square root of the pressure of water fed into the internal passageway in pounds per square inch gauge; a deflector coupled with the tubular body and spaced from and generally aligned with the discharge end of the internal passageway so as to be impacted by a flow of water issuing from the discharge end of the passageway upon activation of the sprinkler, the deflector being configured and positioned to deflect the flow of water generally radially outwardly all around the sprinkler; a closure releasably positioned at the discharge end of the tubular body so as to close the internal passageway; and a heat responsive trigger mounted to releasably retain the closure at the discharge end of the tubular body, the trigger having a response time indices of less than 100 meter$^{1/2}$sec$^{1/2}$ (m$^{1/2}$sec$^{1/2}$).

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings which are diagrammatic:

FIG. 2 is a partial cross-sectional view of the sprinkler taken generally along the lines of 2—2 in FIG. 1;

FIG. 3 is a greatly enlarged view of the encircled area 3 of FIG. 2;

DETAILED DESCRIPTION OF THE INVENTION

Figure 1:
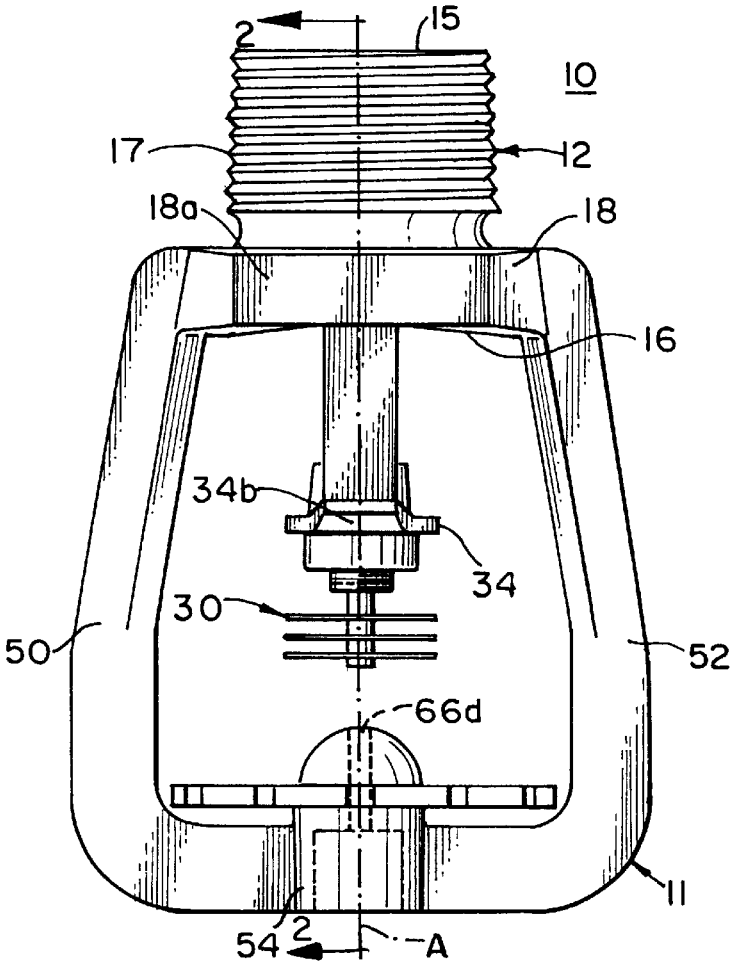
FIG. 1 is an elevation view of an low pressure, early suppression fast response ceiling sprinkler of the present invention.

In the drawings, like numerals are used to indicate like elements throughout. There is shown in various views in FIGS. 1, 2 and 5, a low pressure, early suppression fast response fire sprinkler of the present invention indicated generally at 10. Sprinkler 10 includes a preferably one-piece frame 11 having an at least generally tubular body indicated generally at 12 with a preferably tapered, central, internal passageway 14. The passageway 14 preferably extends straight between an inlet end 15 and a discharge end 16 of the tubular body 12. Threads 17 are provided on the outside of the inlet end 15 to permit the sprinkler 10 to be coupled to a drop or supply pipe (neither depicted) for delivery of water or another fire fighting fluid. The internal passageway 14 of body 12 has a preferably straight central axis A indicated in FIGS. 1 and 2.

Sprinkler 10 further includes a closure 20 releasably positioned at the discharge end 16 of the tubular body 12 so as to close the internal passageway 14, a heat responsive trigger indicated generally at 30 mounted to releasably retain the closure 20 at the discharge end 16 of the tubular body 12 closing the passageway 14 until the trigger 30 is activated, and a deflector indicated generally at 60.

Referring to FIG. 1, the frame 11 further includes a pair of support arms 50, 52 which extend generally away from opposite sides of the discharge end 16 of the tubular body 12 and meet to form a tubular knuckle 54 located along central axis A. The arms 50, 52 and knuckle 54 support the deflector 60 positioned juxtaposed to, facing and spaced away from the discharge end 16 of the tubular body 12. While at least two symmetrically positioned support arms 50, 52 are preferred, three or four support arms might be provided, preferably all symmetrically positioned around and spaced away from the central axis A. Where more than two support arms are provided, they may be separately attached to a tubular body, for example, by being threaded into a flange portion of such separate tubular body.

The frame 11 is preferably enlarged at the discharge end 16 of the tubular body 12 into a circumferential flange 18. The flange 18 is preferably hexagonally shaped with a pair of major opposing parallel flat surfaces or "flats" 18*a* positioned to receive an open ended wrench or a specially designed hexagonal sprinkler wrench for threading the sprinkler 10 into a drop or other fluid supply line (neither depicted).

Referring to FIG. 2, the internal passageway 14 includes an inwardly tapering portion 14*a* extending from the inlet end 15 to a cylindrical portion 14*b* of uniform, reduced diameter. A portion 14*c* of the passageway immediately downstream from the reduced diameter portion 14*b* is provided with a greater diameter to receive the closure 20 over the reduced diameter portion 14*b*. Portion 14*c* may be outwardly beveled at approximately a 10°–15° angle for its length to foster release of the closure 20 (see FIG. 3). The passageway 14 then abruptly and significantly enlarges in diameter into a cylindrical outlet opening 14*d* at the discharge end 16 of the frame body 12. A lip 19 is formed around the outlet opening 14*d* by the provision of a circular groove 14*e* between the lip 19 and the beveled end of portion 14*c* of the passageway.

The tubular body 12 may have an axial length of about one and one-third inches with the flange 18 having a length of about one-third inch. The inwardly tapering potion 14*a* may have a length of about seven-eighths of an inch and taper down at about a one and one-half degree angle to central axis A from a width of 0.98 to a width of 0.93 inches, which is continued for about one-eighth of an inch in reduced diameter portion 14*b*. Portion 14*c* may have a minimum diameter of about one inch and a length of about one-sixteenth inch. In the preferred embodiment, the outlet opening 14*d* may have a diameter of about one and one-third inches and an axial length of about one-third inch while the groove 14*e* has a diameter of about one and one-half inches and an axial length of only about one-eighth inch.

The preferred sprinkler 10 has a nominal discharge coefficient or K factor of 25. The discharge coefficient or K factor equals the flow of water through the internal passageway 14 in gallons per minute divided by the square root of the pressure of water fed into the tubular body in pounds per square inch gauge. The discharge coefficient is governed in a large degree by the smallest cross sectional area of the passageway 14, in other words, the diameter of the cylindrical portion 14*b* of passageway 14.

The discharge coefficient or "K" factor of a sprinkler is determined by standard low testing. For ESFR sprinklers, ay 14 is measured first at a pressure of 15 psig, and then in 5 psig increments up to 50 psig and then in 10 psig increments up to 100 psig, and then in 25 psig increments at 125, 150 and 175 psig. The flow is decreased in the same increments back to the original 15 psig value. The flow is measured at each increment of pressure by a flow-measuring device having an accuracy within about 2 percent of the actual flow. The actual flow in gallons per minute is divided by the square root of the pressure of the supplied water in psig at each increment. An average value is then calculated from all of the incremental values and becomes the flow coefficient or "K" factor of the sprinkler.

Discharge coefficients of K factors can be "nominal" values. Typically "nominal" K factors are expressed in standard sizes, which are integer or half integer values. Th se standard or "nominal" values encompass the stated integer or half integer value plus or minus one-half integer. Thus, a nominal K factor of 25 encompasses all measured K factors between 24.5 and 25.5.

Referring to FIG. 2, the closure 20 preferably is also a subassembly and has an upstream end 20*a*, which is received over the reduced diameter portion 14*b* of the passageway 14 in the beveled portion 14*c* of the passageway. A downstream end 20*b* of the closure 20 engages a proximal end of the trigger 30. Referring to FIG. 3, the closure 20 is formed by a saddle 22 and a washer subassembly that includes a Belleville washer 26 bearing a sheet of plastic film tape 28, preferably a triflouroethylene tape on one side, which is the side of the closure 20 facing the uniform reduced diameter portion 14*b* of the passageway 14. Saddle 22 is a generally rotationally symmetric body including a cylindrical plug portion 22*a*, which is received within a center opening of the Belleville washer 26 to stabilize the washer with respect to the saddle 22. The saddle has a circular flange portion 22*b* with an outer diameter approximately equal to the outer diameter of the Belleville washer 26 and slightly greater than the diameter of reduced diameter portion 14*b*. Saddle 22 further includes a central circular boss 22*c* projecting away from the plug portion 22*a* with a threaded central bore 22*d*.

The preferred trigger 30 is an assembly which preferably includes a pair of identical, generally L-shaped levers 32.

Each lever 32 includes a short arm portion 32*a,* which is positioned between lip 19 and the downstream end 20*b* of the closure 20, releasably retaining the closure 20 in the internal passageway 14 closing the passageway. Long arm portions 32*b* of the levers 32 extend away from discharge end 16 of the tubular body 12 and passageway 14 and are held together by a lever yoke 34. Yoke 34 preferably is a one-piece, generally octagonally-shaped body with a central circular opening. Diametrically opposed portions 34*b* and 34*c* of the body are bent around the proximal long ends 32*b* of the levers 32, thereby holding those ends together and releasably retaining the closure 20 in the passageway 14 so as to close the passageway 14. Cutouts can be provided on the outer edges of the flange portion 22*b* of the saddle to receive and stabilize the position of the short arm portions 32*a* of the levers 32.

Figure 4:
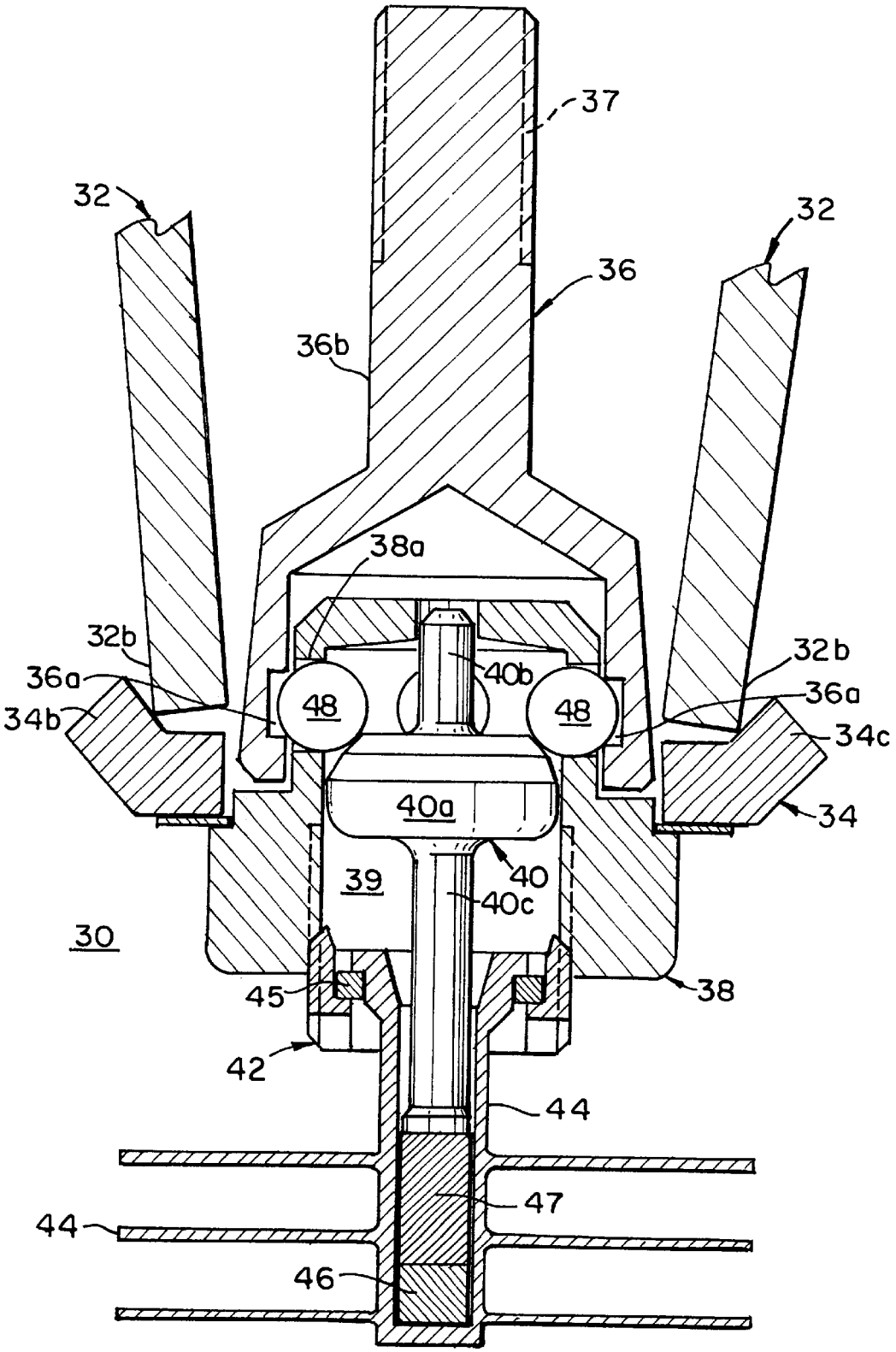
FIG. 4 is a sectional elevation of the trigger.

Referring to FIGS. 2 and 4, trigger 30 further includes a retainer body 36, a plunger housing 38 having one end received in the retainer body 36 and a retaining nut received in a remaining end of the plunger housing 38 and forming a plunger chamber 39 receiving a plunger 40. Those and other elements of trigger 30 are best seen in FIG. 4. A retaining nut 43 supports a finned heat collector 44 from a side of the plunger housing 38 opposite the retainer body 36. The finned heat collector 44 is preferably coupled with and thermally insulated from the retaining nut 43 by a thermally insulative support washer 45 of a suitable material such as glass reinforced nylon. The finned heat collector 44 is hollow and contains a pellet 46 of a metal alloy having a melting temperature at the desired operating or response temperature of the sprinkler 10. Plunger 40 is formed by a pin and a generally bulbous main body 40*a* along the pin, which divides the pin into upper and lower ends 40*b* and 40*c*. The lower pin end 40*c* of plunger 40 is supported on the metal alloy pellet 46 by a cylindrical bearing disk 47 made of a material such as alumina having significant compressive strength and thermal insulative properties. The upper pin end 40*b* guides and centers the plunger 40 in the chamber 39. The purpose of the pellet 46, bearing disk 47 and plunger 40 is to support a plurality of balls 48 which extend through bores 38*a* in the side walls of the plunger housing 38 and into aligned recesses 36*a* in the retainer body 36 thereby releasably locking the retainer body 36 and plunger housing 38 together. The "free" or "upper end" 36*b* of the retainer body 36 bears external threads 37 (diagrammatically by phantom), which are received in the threaded central bore 22*d* of the saddle 22 of the closure 20. Levers 32, which are held together by lever yoke 34, releasably retain closure 20 in the tubular body 12. The retainer body 36 is held through saddle 22 and the remainder of the trigger 30 is coupled with the saddle through the retainer body 36 by means of the balls 48. The balls 48, in turn, are held by the bulbous main body 40*a* of the plunger 40, which is forced against the balls 48 by tightening of the retaining nut 43 into the plunger housing 38. The alloy pellet 46 will lose its load bearing strength when heated sufficiently allowing the balls to move and permitting the plunger housing 38 and lever yoke 34 to separate from the retainer body 36 and levers 32, respectively, releasing closure 20 with trigger 30 permitting water (or other fire fighting fluid) to pass through the internal passageway 14 and from the discharge end 16 of the passageway 14 and body 12.

Figure 5:
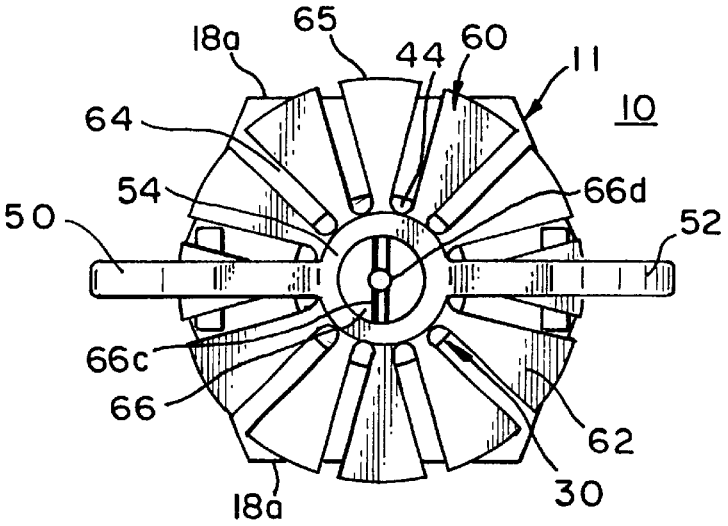
FIG. 5 is a bottom view of the sprinkler of FIG. 1.

The structure and mounting of the deflector 60 are best seen in FIGS. 1, 2 and 5. Deflector 60 includes a plate 62, and a nose piece positioned in an opening in the center of the plate 62.

The plate 62 of the deflector is planar and circular with a circular outer perimeter 63 and a plurality of slots 64 extending radially inwardly from the circular perimeter 63 and axially entirely through the plate 62. The plurality of slots 64 surround and define a "slotless" central area 65 as best seen in FIG. 2. As used herein "slotless central area" refers to a circular central area at the center of the deflector, which has a radius equal to the radius of the plate member less the radial length of the longest slot extending radially from the outer perimeter of the plate member in a planar projection of the deflector prependicular to central axis A. Thus, if the nose piece of the deflector overlaps the innermost ends of some or all of the slots, the slotless central area is the planar area of the nose piece which covers the ends of such slots. In the preferred embodiment, the outer diameter of the central area 65 is substantially equivalent to the outer diameter of the frame knuckle 54.

The nose piece 66 has a head portion 66*a* facing the tubular body 14 which is suggestedly rounded in shape and preferably hemispheric. The head portion 66*a* supports a shaft portion 66*b* bearing external threads 67 (indicated diagrammatically by phantom lines) which permit the nose piece 66 to be screwed into the internally threaded knuckle 54. A slot 66*c* may be provided at the base of the shaft portion 66*b* to receive a screw driver. The nose piece passes through a circular opening 62*a* provided in the center of the deflector plate 62 (within the central area 65) and holds the plate 62 firmly to the knuckle 54. The deflector 60 is coupled with the tubular body 14 through knuckle 54 and is positioned juxtaposed to and spaced from the discharge end 16 of the tubular body 12 aligned with the discharge end 16 of the internal passageway central axis A of the tubular body. Nose piece 66 is further preferably provided with a central bore 66*d* also aligned with the central axis A of the internal passageway 14 and discharge end 16 of the tubular body 12. The deflector 60 is configured by being generally rotationally symmetric and positioned by being centered on central axis A to deflect the flow of water issuing from the discharge end of internal passageway 14 generally symmetrically radially outwardly all around the sprinkler 10. Bore 66*d* permits water to pass axially entirely through the center of the deflector 60 and down directly under the sprinkler 10. This bore 66*d* combined with the much larger orifice size of internal passageway 14 in comparison to the diameter of the slotless central area of the deflector has proven sufficient to deliver adequate water densities directly beneath the sprinkler 10 to suppress high challenge fires originating directly under sprinkler 10 as well as to such fires originating between such sprinklers 10.

Sprinklers 10 of the present invention are installed in accordance with standard ESFR limitations including spacing and height limitations.

For the preferred 25 K factor tubular body having a minimum diameter of 0.930 inches in the reduced diameter cylindrical portion 14*b* of the internal passageway 14, the head portion 66*a* of the nose piece 66 is provided with a radius of about one-quarter inch and with a bore 66*d* having a diameter of about one-eighth inch. The deflector plate 62 is preferably 1.9 inches in outer diameter and about one-tenth of an inch thick. Plate 62 is provided with twelve slots 64 uniformly angularly arrayed in 30° increments around central axis A. Each slot 64 is about one-tenth inch in width and terminates in a radius (semicircle). The diameter of the central area surrounded by and located within the slots 64 is suggestedly about five-eighths inch.

The surface of the knuckle 54 closest to the tubular body 14 is spaced about two and one-half inches from the proximal end of the reduced diameter cylindrical portion 14*b* of the internal passageway 14. The ratio of the outer diameter of the deflector 60, more particularly the deflector plate 62, to the radial length of the slots 64 is about 3 (1.9/0.635). The plurality of slots 64 provide a total open area of less than one-third but more than one-quarter the total planar area within the circular perimeter 63 of the deflector. All of these values are within the ranges exhibited by existing ESFR sprinklers. However, the ratio of the minimum passageway diameter of the tubular body to the diameter of the central area of the deflector is about 1.5 (0.93 in/0.624 in). The highest ratio previously exhibited in an ESFR sprinkler was less than 1.3.

One of the requirements for an ESFR sprinkler is fast response. Response can be measured in various ways. Factory Mutual and Underwriters Laboratories, use a combination of temperature ratings and response time indices to insure adequately fast response is being provided.

The response time indices or "RTI" is a measure of thermal sensitivity and is related to the thermal inertia of a heat responsive element of a sprinkler. RTI is insensitive to temperature. For fast-growing industrial fires of the type to be protected by ESFR sprinklers, it is believed that the RTI and temperature rating of the trigger are sufficient to insure adequately fast sprinkler response. The temperature rating is the range of operating temperatures at which the heat responsive element of a sprinkler will activate.

RTI is equal to $\tau u^{1/2}$ where $\tau$ is the thermal time constant of the trigger in units of seconds and u is the velocity of the gas across the trigger. RTI is determined experimentally in a wind tunnel by the following equation:

$$RTI=-t_x u^{1/2}/1n(1-\Delta T_b/\Delta T_g)$$

where $t_x$ is the actual measured response or actuation time of the sprinkler; u is the gas velocity in the test section with the sprinkler; $\Delta T_b$ is the difference between the actuation temperature of the trigger (determined by a separate heat soak test) and the ambient temperature outside the tunnel (i.e. the initial temperature of the sprinkler); and $\Delta T_b$ is the difference between the gas temperature within the tunnel where the sprinkler is located and the ambient temperature outside the tunnel. The RTI for ESFR sprinkler is determined with air heated to 197 (±2)° C. and passed at a constant velocity of 2.56 (±0.03) m/sec over the sprinkler 10 and trigger 30 inserted into the air stream in the pendent position (see FIG. 1) with a plane through frame arms 50, 52 being perpendicular to the direction of the heated air. The aforesaid FM and UL Standards should be consulted for further information if desired.

When fast response was being investigated in the 1980's, the RTI's so-called standard sprinklers were measured and were found to be more than 100 $m^{1/2}sec^{1/2}$ typically up to nearly 400 $m^{1/2}sec^{1/2}$. RTI's of less than 100 $m^{1/2}sec^{1/2}$ are considered faster than standard sprinkler responses. A class of "special" sprinklers has been recognized having RTI's between 80 and 50 $m^{1/2}sec^{1/2}$. RTI values currently acceptable for ESFR sprinklers are less than 40 $m^{1/2}sec^{1/2}$, more particularly 19 to 36 m½$sec^{1/2}$. Applicants' sprinkler is the first known sprinkler to combine any K factor of more than 16 with any trigger (thermally responsive element) having an RTI of less than 100 or even 80 or less $m^{1/2}sec^{1/2}$ for any use and also the first having such combined parameters to successfully suppress a high challenge fire as demonstrated by standard laboratory tests.

The 25 K factor sprinkler 10 will supply 100 gallons per minute at a flow pressure of less than 16 psig while one with a K factor of 26 will supply 100 gallons per minute at just under 15 psi. Applicants believe that 15 psi is the minimum pressure needed to drive drops of the size generated by the sprinkler 10 into the heated plume created by a high challenged fire. The nominal 25 K sprinkler of the present invention therefore is believed to be optimally-sized for its use. However, ESFR sprinklers providing 100 gallon per minute flows at pressures of more than 15 but less than 50 psi can also be commercially valuable. To supply 100 g.p.m. of water at 40 psi requires a K factor of about 16 (15.8). To supply the same amount of water at 30 psig requires a K factor of about 18.5 (18.3) while to supply the same amount of water at 20 psig requires a K factor of about 22.5 (22.4). The reduced diameter portion **14*b*** of the internal passageway might have a diameter greater than 0.76 inches to yield a K-factor greater than 16, a diameter of about 0.85 inches to yield a nominal K-factor of about 20, a diameter of about 1.0 inch to yield a K-factor of about 30 and a diameter of about 1.2 inches to yield a K-factor of about 40.

Furthermore, investigations are underway with respect to the suppression of fires even more challenging than those addressed by the original ESFR sprinkler standards. These higher challenges include storage in warehouses piled up to forty feet under forty-five foot ceilings and up to forty-five feet under fifty-foot ceilings. Applicants believe that water might similarly be supplied in even greater quantities at flow pressures of at least 15 psig to successfully suppress such fires. For example, a flow rate of 120 gallons per minute can be supplied at a pressure of 15 psig (or less) by a K factor of about 31,140 gallons per minute by a K factor of about 36, and 150 gallons per minute by a K factor of less than 40 (38.7). At pressures of 20 psig, 120 gallons per minute can be supplied by a K-factor of about 27 (26.8), 140 gallons per minute can be supplied by a K-factor of about 31.5 (31.3) and 150 gallons per minute can be supplied by a K-factor of about 33.5.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A fast response sprinkler comprising:

a generally tubular body having an inlet end, an opposing discharge end, an internal passageway extending between the inlet and discharge ends and a K factor greater than 16 where the K factor equals the flow of water in gallons per minute through the internal passageway divided by the square root of the pressure of water fed into the tubular body in pounds per square inch gauge, and a plurality of support arms extending generally away from the discharge end of the generally tubular body and meeting generally along the central axis spaced from the discharge end of the generally tubular body;

a deflector coupled with the generally tubular body through the plurality of support arms so as to be spaced from and generally aligned with the discharge end of the internal passageway and the central axis and impacted by a flow of water issuing from the discharge end of the internal passageway upon activation of the sprinkler, the deflector being configured and positioned to deflect the flow of water generally radially outwardly all around the sprinkler to provide suppression of a fire wherein the deflector has an outer perimeter with a plurality of slots extending therethrough and defining a circular slotless central area, the internal passageway having a minimum diameter greater than the maximum diameter of the circular slotless central area;

a closure releasably positioned at the discharge end of the generally tubular body so as to close the internal passageway; and a heat responsive trigger mounted to releasably retain the closure at the discharge end of the generally tubular body, the trigger having a response time index of less than 100 meter$^{1/2}$sec$^{1/2}$ (m$^{1/2}$sec$^{1/2}$).

2. The fast response sprinkler of claim 1, wherein at least one of the plurality of support arms tapers down to a lesser size in at least a first transverse cross-sectional dimension as the support arm extends away the discharge end of the tubular body.

3. The fast response sprinkler of claim 1, wherein the plurality of support arms and the tubular body are formed in one piece as a single member.

4. The fast response sprinkler of claim 1, wherein the plurality of support arms meet to form an enlarged knuckle supporting the deflector.

5. The fast response sprinkler of claim 4, wherein the deflector comprises a plate portion and a head portion projecting from a major side of the plate member facing the discharge end of the tubular body.

6. The fast response sprinkler of claim 5, wherein at least the head portion of the deflector is centered on the central axis.

7. The fast response sprinkler of claim 6, wherein at least the head portion of the deflector is symmetric with respect to the central axis.

8. The fast response sprinkler of claim 5, wherein the head portion is generally rounded in shape.

9. The fast response sprinkler of claim 8, wherein the head portion is generally hemispheric in shape.

10. The fast response sprinkler of claim 5, wherein the head portion at least substantially overlaps the knuckle in an axial direction of the deflector and the knuckle.

11. The fast response sprinkler of claim 5, herein the head portion is part of a nose piece and the plate portion is a plate member separate from the nose piece and wherein the nose piece is used to secure the plate member with the knuckle.

12. The fast response sprinkler of claim 11, wherein the nose piece includes a shaft portion extending through a central opening in the plate member.

13. The fast response sprinkler of claim 12, wherein the knuckle includes a bore receiving at least a distal end of the shaft portion of the nose piece.

14. The fast response sprinkler of claim 11, wherein the nose piece has an axial bore extending generally along the central axis.

15. The fast response sprinkler of claim 14, wherein the axial bore extends entirely through the nose piece and the knuckle.

16. The fast response sprinkler of claim 5, wherein the plate portion has an outer perimeter, a plurality of slots extending generally radially inwardly from the outer perimeter toward the central axis and the deflector has a slotless central area located radially within the plurality of slots, the slotless central area of the deflector substantially overlapping the knuckle in an axial direction.

17. The fast response sprinkler of claim 16, wherein each of the plurality of slots has a uniform length from the outer perimeter inwardly toward the central axis.

18. The fast response sprinkler of claim 17, wherein the outer perimeter of the plate is circular.

19. The fast response sprinkler of claim 18, wherein the area of the plate radially within the slots is circular.

20. The fast response sprinkler of claim 5, wherein the plate portion of the deflector has an outer perimeter with a plurality of slots extending axially entirely through the plate portion and radially inwardly into the plate portion from the outer perimeter, the plurality of slots surrounding a circular slotless central area having a maximum diameter.

21. The fast response sprinkler of claim 20, wherein the internal passageway has a minimum diameter and wherein a ratio of the minimum diameter of the internal passageway to the maximum diameter of the slotless central area of the deflector is greater than 1.3.

22. The fast response sprinkler of claim 21, wherein the ratio is at least about 1.5.

23. The fast response sprinkler of claim 20, wherein the plate portion has an outer diameter and each of the plurality of slots has a radial length and wherein a ratio of the outer diameter of the plate portion to the radial length of at least some of the plurality of slots is about 3.

24. The fast response sprinkler of claim 23, wherein the plurality of the slots provide a total open area of less than one-third of the total planar area within the outer perimeter of the plate portion.

25. The fast response sprinkler of claim 1, wherein the heat responsive trigger is an assembly including at least one lever.

26. The fast response sprinkler of claim 25, wherein the least one lever includes a plurality of levers releasably engaged with the discharge end of the tubular body and the closure.

27. The fast response sprinkler of claim 26, wherein the plurality of levers are releasably engaged with the tubular body only at the discharge end.

28. The fast response sprinkler of claim 25, wherein the heat responsive trigger assembly further comprises a yoke releasably engaged with the at least one lever so as to retain the at least one lever in releasable engagement with the closure.

29. The fast response sprinkler of claim 28, wherein the heat responsive trigger assembly further comprises at least one movable lock member and a movable plunger immobilized by a heat responsive member so as to maintain at least one movable lock member in engagement with both a housing member and a retainer body to releasably hold the housing member and the retainer body in engagement together.

30. The fast response sprinkler of claim 1, wherein the closure comprises a Belleville washer.

31. The fast response sprinkler of claim 30, wherein the closure further comprises a saddle with a plug portion received within a center opening of the Belleville washer.

32. The fast response sprinkler of claim 31, wherein the saddle has a circular flange portion overlapping the Belleville washer.

33. The fast response sprinkler of claim 32, wherein the circular flange portion has an outer diameter approximately equal to an outer diameter of the Belleville washer.

34. The fast response sprinkler of claim 1, wherein the K factor is greater than 20.

35. The fast response sprinkler of claim 34, wherein the K factor is between 22 and 26.

36. The fast response sprinkler of claim 34, wherein the response time index is less than 40 m$^{1/2}$sec$^{1/2}$.

37. The fast response sprinkler recited in claim 36, wherein the sprinkler is beneath a ceiling having a height of fifty feet or less, and a flow of water supplied to the inlet end of the tubular body has a pressure between 15 and 50 pounds per square inch gauge.

38. The fast response sprinkler of claim 37, wherein the sprinkler is located above storage situated in racks.

39. The fast response sprinkler recited in 38, wherein the ceiling has a height of approximately thirty feet.

40. An early suppression, fast response sprinkler comprising:

a generally tubular body having an inlet end, an opposing discharge end, an internal passageway extending between the inlet end and the discharge end, and a K factor between 20 and 26, where the K factor equals the flow of water in gallons per minute through the internal passageway divided by the square root of the pressure of water fed into the generally tubular body in pounds per square inch gauge;

a closure releasably positioned at the discharge end of the generally tubular body so as to prevent a flow of water through the internal passageway;

a heat responsive trigger having a response time index of less than 40 $meter^{1/2}sec^{1/2}$, the heat responsive trigger retaining the closure at the discharge end of the generally tubular body until actuated;

a pair of support arms extending generally away from opposite sides of the discharge end of the generally tubular body, the arms meeting to form a knuckle spaced away from the discharge end of the generally tubular body;

a plate disposed between the knuckle and the discharge end of the generally tubular body, the plate having a first planar surface facing the discharge end of the generally tubular body, a second planar surface facing the knuckle, and a plurality of slots extending between the first planar surface and the second planar surface wherein the plate has a circular outer perimeter and the plurality of slots extend radially inwardly into the plate from the circular outer perimeter, the slots surrounding a circular slotless central area having a maximum diameter, the internal passageway having a minimum diameter greater than the maximum diameter of the circular slotless central area; and a nose piece having a head portion, the head portion including a curved surface facing the discharge end of the generally tubular body, the nose piece being aligned with the plate so that, when the heat responsive trigger is actuated and the closure is positioned to allow a flow of water to issue from the discharge end of the generally tubular body, the flow of water impacts the nose piece and the plate and deflects so that a fire in storage situated beneath a ceiling is suppressed.

41. The early suppression, fast response sprinkler recited in claim 40, wherein the ceiling has a height of less than fifty feet.

42. The early suppression, fast response sprinkler of claim 41, wherein the pressure of the flow of water supplied to the inlet end of the generally tubular body is at 50 psig or less and the rate of the flow of water issuing from of the discharge end of the generally tubular body is 100 gpm or more.

43. The early suppression, fast response sprinkler of claim 41, wherein the flow of water supplied to the inlet end of the generally tubular body has a minimum pressure of 50 psig or less.

44. The early suppression, fast response sprinkler of claim 43, wherein the storage is situated in racks.

45. The early suppression, fast response sprinkler recited in claim 40, wherein the ceiling has a height of thirty feet or less, and the flow of water supplied to the inlet end of the tubular body has a minimum pressure between 15 and 50 psig.

46. The early suppression, fast response sprinkler of claim 45, wherein the storage is situated in racks.

47. The early suppression, fast response sprinkler of claim 40, wherein the flow of water impacts the nose piece and the plate and deflects so that the fire in storage situated beneath the ceiling is extinguished.

48. The early suppression, fast response sprinkler recited in claim 47, wherein the ceiling has a height of fifty feet or less, and the flow of water supplied to the inlet end of the generally tubular body has a minimum pressure between 15 and 50 psig.

49. The early suppression, fast response sprinkler of claim 48, wherein the storage is situated in racks.

50. The early suppression, fast response sprinkler recited in claim 49, wherein the ceiling has a height of approximately thirty feet, and the flow of water supplied to the inlet end of the generally tubular body has a minimum pressure between 15 and 30 psig.

51. The early suppression, fast response sprinkler of claim 50, wherein the flow of water issuing from the discharge end of the generally tubular body is 100 gpm or more.

52. The early suppression, fast response sprinkler of claim 40, wherein the pair of support arms and the generally tubular body are formed in one-piece as a single member.

53. The early suppression, fast response sprinkler of claim 40, wherein the plate has a central opening and the nose piece is positioned in the central opening.

54. The early suppression, fast response sprinkler of claim 40, wherein the curved surface of the head portion of the nose piece is rounded.

55. The early suppression, fast response sprinkler of claim 40, wherein the nose piece comprises a central bore to permit passage of water axially entirely through the nose piece.

56. The early suppression, fast response sprinkler of claim 40, wherein the internal passageway, the nose piece, the plate, and the knuckle are aligned along a central axis.

57. The early suppression, fast response sprinkler of claim 56, wherein the head portion at least substantially overlaps the knuckle in a direction along the central axis from the internal passageway toward the knuckle.

58. The early suppression, fast response sprinkler of claim 56, wherein the first planar surface and the second planar surface are both substantially perpendicular to the central axis.

59. The early suppression, fast response sprinkler of claim 56, wherein the plurality of slots comprises twelve slots uniformly arranged about the central axis.

60. The early suppression, fast response sprinkler of claim 59, wherein the twelve slots are uniformly arranged in 30° increments about the central axis.

61. The early suppression, fast response sprinkler of claim 60, wherein each of the twelve slots extends from an opening at a circular outer perimeter of the plate toward the central axis for an equal length, and each of the twelve slots terminates in a radius.

62. The early suppression, fast response sprinkler of claim 40, wherein threads are provided on tn outside of the inlet end of the generally tubular body.

63. The early suppression, fast response sprinkler of claim 40, wherein a flange with at least two flats is provided on an outside of the discharge end of the generally tubular body.

64. The early suppression, fast response sprinkler of claim 63, wherein the at least two flats comprise eight flats in a hexagonal shape, and the at least two flats are positioned to receive an open end of a wrench.

65. The early suppression, fast response sprinkler of claim 40, wherein the closure comprises a saddle and a washer.

66. The early suppression, fast response sprinkler of claim 40, wherein a ratio of the minimum diameter of the internal passageway to the maximum diameter of the circular slotless central area of the deflector is greater than 1.3.

67. The early suppression, fast response sprinkler of claim 66, wherein the minimum diameter of the internal passageway is between 0.75 and 1.2 inches.

68. The early suppression, fast response sprinkler of claim 40, wherein the minimum diameter of the internal passageway is between 0.75 and 1.2 inches.

69. The early suppression, fast response sprinkler of claim 40, wherein the plurality of the slots provide a total open area of less than one-third of a total planar area of the first planar surface within an outer perimeter of the plate.

70. The early suppression, fast response sprinkler of claim 40, wherein the heat responsive trigger comprises an assembly of components.

71. The early suppression, fast response sprinkler of claim 70, wherein the assembly of components comprises at least one lever.

72. An early suppression, fast response sprinkler comprising:

a generally tubular body having an inlet end, an opposing discharge end, an internal passageway extending between the inlet end and the discharge end, the internal passageway including a minimum diameter between 0.75 and 1.2 inches;

a closure releasably positioned at the discharge end of the generally tubular body so as to prevent a flow of water through the internal passageway;

a heat responsive trigger having a response time index of less than 40 $meter^{1/2}sec^{1/2}$, the heat responsive trigger retaining the closure at the discharge end of the generally tubular body until actuated, a pair of support arms extending generally away from opposite sides of the discharge end of the generally tubular body and meeting away from the discharge end of the generally tubular body;

a plate being surrounded by the pair of support arms, the plate having a plurality of slots wherein the plate has a circular outer perimeter and the plurality of slots extend radially inwardly into the plate from the circular outer perimeter, the slots surrounding a circular slotless central area having a maximum diameter, the internal passageway having a minimum diameter greater than the maximum diameter of the circular slotless central area, and a ratio of the minimum diameter of the internal passageway to the maximum diameter of the circular slotless central area of the deflector is greater than 1.3;

a nose piece having a head portion, the head portion including a curved surface facing the discharge end of the generally tubular body, the nose piece being aligned with the plate so that, when the heat responsive trigger is actuated and the closure is positioned to allow a flow of water to issue from the discharge end of the generally tubular body, the flow of water impacts the nose piece and the plate and deflects so that a fire in storage situated beneath a ceiling is suppressed.

73. The early suppression, fast response sprinkler of claim 72, wherein the pressure of the flow of water supplied to the inlet end of the generally tubular body is between 15 and 50 psig or less and the rate of the flow of water issuing from of the discharge end of the generally tubular body is 100 gpm or more.

74. The early suppression, fast response sprinkler recited in claim 72, wherein the ceiling has a height of fifty feet or less.

75. The early suppression, fast response sprinkler of claim 74, wherein the storage is situated in racks.

76. The early suppression, fast response sprinkler of claim 72, wherein the flow of water impacts the nose piece and the plate and deflects so that the fire in storage situated beneath the ceiling is extinguished.

77. The early suppression, fast response sprinkler of claim 72, wherein the plate has a central opening and the nose piece is positioned in the central opening.

78. The early suppression, fast response sprinkler of claim 72, wherein the at least one curved surface of the head portion of the nose piece is rounded.

79. The early suppression, fast response sprinkler of claim 72, wherein the nose piece comprises a bore to permit passage of water axially entirely through the nose piece.

80. The early suppression, fast response sprinkler of claim 72, wherein the internal passageway, the nose piece, and the plate, are aligned along a central axis, the plurality of slots includes twelve slots uniformly arranged about the central axis in 30° increments about the central axis, each of the twelve slots extends from an opening at a circular outer perimeter of the plate toward the central axis for an equal length, and each of the twelve slots terminates in a radius.

81. The early suppression, fast response sprinkler of claim 72, wherein the closure comprises a saddle and a washer.

82. The early suppression, fast response sprinkler of claim 72, wherein the heat responsive trigger comprises an assembly of components including at least one lever.

83. A low pressure, fast response sprinkler comprising:

a generally tubular body having an inlet end, an opposing discharge end, an internal passageway extending between the inlet end and discharge end with a K factor greater than 16, where the K factor equals the flow of water in gallons per minute through the internal passageway divided by the square root of the pressure of water fed into the tubular body in pounds per square inch gauge, and a plurality of support arms extending generally away from the discharge end of the generally tubular body;

a closure releasably positioned at the discharge end of the tubular body so as to close the internal passageway, the closure including a saddle;

a heat responsive trigger mounted to releasably retain the closure at the discharge end of the tubular body, the trigger having a response time index of less than 100 $meter^{1/2}sec^{1/2}$ ($m^{1/2}sec^{1/2}$); and means for deflecting a flow of water to suppress a fire, the flow of water issuing from the discharge end of the generally tubular body upon actuation of the heat responsive trigger, the means for deflecting being coupled to the plurality of support arms wherein the means for deflecting comprises a plate member including a circular outer perimeter with an outer diameter and a plurality of slots extending inwardly from the outer perimeter and axially entirely through the plate member, the slots surrounding a circular slotless central area of the plate member, and the tubular body having a minimum central passageway diameter greater than a maximum diameter of the circular slotless central area.

84. The low pressure, fast response sprinkler of claim 83, wherein the means for deflecting comprises an opening extending axially through the means for deflecting along a central axis so as to permit passage of water axially entirely through the means for deflecting along the central axis.

85. The low pressure, fast response sprinkler of claim 83, wherein the means for deflecting comprises a nose piece with a rounded head.

86. The low pressure, fast response sprinkler of claim 83, wherein the flow of water is supplied to the inlet end of the generally tubular body at 50 psig or less, and a rate of the flow of water issuing from of the discharge end of the generally tubular body is at least 100 gpm.

87. The low pressure, fast response sprinkler of claim 83, wherein the K factor is greater than 20 and the response time index is less than 40 $meter^{1/2}sec^{1/2}$.

88. The low pressure, fast response sprinkler of claim 83, wherein the internal passageway of the tubular body has a minimum orifice diameter between 0.75 and 1.2 inches.

89. An installed low pressure, fast response sprinkler comprising:

a generally tubular body having an inlet end, an opposing discharge end, an internal passageway extending between the inlet and discharge ends and a K factor greater than 16 where the K factor equals the flow of water in gallons per minute through the internal passageway divided by the square root of the pressure of water fed into the tubular body in pounds per square inch gauge, and a plurality of support arms extending generally away from the discharge end of the generally tubular body;

a deflector coupled with the tubular body through the plurality of support arms so as to be spaced from and generally aligned with the discharge end of the internal passageway and impacted by a flow of water issuing from the discharge end of the internal passageway upon activation of the sprinkler, the deflector being configured and positioned to deflect the flow of water generally radially outwardly all around the sprinkler to provide suppression of a fire wherein the deflector has an outer perimeter with a plurality of slots extending therethrough and defining a circular slotless central area, the internal passageway having a minimum diameter greater than the maximum diameter of the circular slotless central area;

a closure releasably positioned at the discharge end of the generally tubular body so as to close the internal passageway; and a heat responsive trigger mounted to releasably retain the closure at the discharge end of the generally tubular body, the trigger having a response time index of less than 100 $meter^{1/2}sec^{1/2}$ ($m^{1/2}sec^{1/2}$);

the sprinkler being installed beneath a ceiling at a height of fifty feet or less.

90. The installed sprinkler of claim 89, wherein a water supply is coupled with the inlet end of the generally tubular body designed to maintain a water pressure of between 15 and 50 psig against the closure.

91. The installed sprinkler of claim 90, wherein the sprinkler is installed above storage piled up in racks.

92. The installed sprinkler of claim 89, wherein the K factor is greater than 20 and the response time index is less than 40 $m^{1/2}sec^{1/2}$.

* * * * *

UNITED STATES PATENT AND TRADEMARK OFFICE

CERTIFICATE OF CORRECTION

PATENT NO. : 6,502,643 B1
DATED : January 7, 2003
INVENTOR(S) : Meyer et al.

It is certified that error appears in the above-identified patent and that said Letters Patent is hereby corrected as shown below:

Column 4,
Line 25, change "low" to -- flow --;
Line 25, change "ay" to -- passageway --;

Column 6,
Line 9, change "prependicular" to -- perpendicular --;

Column 9,
Line 13, after "away", insert -- from --;

Column 10,
Line 27, before "least"; insert -- at --;
Line 57, change "claim 1" to -- any one of claims 1-33 --;
Line 66, change "and 50 pounds" to -- and less than 50 pounds --;

Column 11,
Line 3, change "38" to -- claim 38 --;
Line 54, change "from of", to -- from --;
Line 66, change "50" to -- less than 50 --;

Column 12,
Line 8, change "claim 47" to -- any one of claims 47, 52-65 and 66-71--;
Line 11, change "50" to -- less than 50 --;
Line 57, change "tn" to -- an --;

Column 13,
Line 62, change "from of" to -- from --;

UNITED STATES PATENT AND TRADEMARK OFFICE

CERTIFICATE OF CORRECTION

PATENT NO. : 6,502,643 B1
DATED : January 7, 2003
INVENTOR(S) : Meyer et al.

It is certified that error appears in the above-identified patent and that said Letters Patent is hereby corrected as shown below:

Column 15,
Line 1, change "claim 83" to -- any one of claims 83-85 --;
Line 3, change "at 50 psig or less" to -- at less than 50 psig --;
Line 6, change "claim 83" to -- any one of claims 83-85 --;

Column 16,
Line 25, change "claim 89" to -- any one of claims 89-91 --.

Signed and Sealed this

Twenty-seventh Day of May, 2003

JAMES E. ROGAN
*Director of the United States Patent and Trademark Office*